US008511080B2

(12) United States Patent
Krajnik et al.

(10) Patent No.: US 8,511,080 B2
(45) Date of Patent: Aug. 20, 2013

(54) HYDRAULIC CONTROL SYSTEM HAVING FLOW FORCE COMPENSATION

(75) Inventors: Andrew J. Krajnik, Romeoville, IL (US); Patrick W. Sullivan, Jr., Tinley Park, IL (US)

(73) Assignee: Caterpillar Inc., Peoria, IL (US)

( * ) Notice: Subject to any disclaimer, the term of this patent is extended or adjusted under 35 U.S.C. 154(b) by 917 days.

(21) Appl. No.: 12/638,104

(22) Filed: Dec. 15, 2009

(65) Prior Publication Data

US 2010/0154401 A1 Jun. 24, 2010

Related U.S. Application Data

(60) Provisional application No. 61/193,778, filed on Dec. 23, 2008.

(51) Int. Cl.
*F15B 11/00* (2006.01)
*E02F 9/22* (2006.01)

(52) U.S. Cl.
USPC ..... 60/452; 60/422

(58) Field of Classification Search
USPC ..... 60/422, 445, 451, 452
See application file for complete search history.

(56) References Cited

U.S. PATENT DOCUMENTS

| | | | | |
|---|---|---|---|---|
| 3,744,243 | A | 7/1973 | Faisandier | |
| 3,788,775 | A | 1/1974 | Leutner et al. | |
| 4,139,987 | A | 2/1979 | Budzich | |
| 4,510,750 | A | 4/1985 | Izumi et al. | |
| 4,655,689 | A | 4/1987 | Westveer et al. | |
| 5,183,393 | A | 2/1993 | Schaffner | |
| 5,666,806 | A * | 9/1997 | Dietz | 60/452 |
| 5,697,764 | A | 12/1997 | Oda et al. | |
| 5,865,602 | A | 2/1999 | Nozari | |
| 6,095,760 | A | 8/2000 | Houtman | |
| 6,202,411 | B1 * | 3/2001 | Yamashita | 60/445 |
| 6,282,892 | B1 * | 9/2001 | Arai | 60/450 |

(Continued)

FOREIGN PATENT DOCUMENTS

| | | |
|---|---|---|
| EP | 0715031 | 6/1996 |
| EP | 0761491 | 3/1997 |
| EP | 0810497 | 12/1997 |
| EP | 0879968 | 11/1998 |

OTHER PUBLICATIONS

Co-pending U.S. Appl. No. 12/637,921, Hydraulic Control System Utilizing Feed-Forward Control, filed Dec. 15, 2009.

*Primary Examiner* — Thomas E Lazo
(74) *Attorney, Agent, or Firm* — Finnegan, Henderson, Farabow, Garrett & Dunner LLP

(57) ABSTRACT

A hydraulic control system for a machine is disclosed. The hydraulic control system may have a pump configured to pressurize fluid, a displacement control valve configured to affect displacement of the pump, and a tool control valve configured to receive pressurized fluid from the pump and to selectively direct to the pressurized fluid to a hydraulic actuator. The hydraulic control system may also have a controller in communication with the displacement control valve. The controller may be configured to determine a pressure gradient across the tool control valve substantially different than a desired pressure gradient, to determine a desired condition of the displacement control valve based the pressure gradient, and to determine a flow force applied to the displacement control valve based on the desired condition. The controller may be further configured to generate a load sense response signal directed to the displacement control valve based on the desired condition and the flow force.

20 Claims, 3 Drawing Sheets

(56) References Cited

U.S. PATENT DOCUMENTS 6,375,433 B1 * 4/2002 Du et al. ..... 417/53
6,438,953 B1 * 8/2002 Kamada ..... 60/422
6,623,247 B2 9/2003 Du
6,789,387 B2 * 9/2004 Brinkman ..... 60/445
6,848,254 B2 * 2/2005 Du ..... 60/452
6,880,332 B2 * 4/2005 Pfaff et al. ..... 60/422
7,089,733 B1 * 8/2006 Jackson et al. ..... 60/422

* cited by examiner

HYDRAULIC CONTROL SYSTEM HAVING FLOW FORCE COMPENSATION

RELATED APPLICATIONS

This application is based upon and claims the benefit of priority from U.S. Provisional Application No. 61/193,778 by Andrew Krajnik et al., filed Dec. 23, 2008, the contents of which are expressly incorporated herein by reference.

TECHNICAL FIELD

This disclosure relates generally to a hydraulic control system and, more specifically, to a hydraulic control system having flow force compensation.

BACKGROUND

Variable displacement pumps are commonly used to provide adjustable fluid flows to machine actuators, for example to cylinders or motors associated with moving machine tools or linkage. Based on a demand of the actuators, the displacement of the pump is either increased or decreased such that the actuators move the tools and/or linkage at an expected speed and/or with an expected force. Historically, the displacement of the pump has been controlled by way of load-sensing, pilot-type valves that are connected to a displacement actuator of the pump.

Although adequate for some situations, pilot-type valves can be slow to respond and inaccurate. That is, because the valves are hydraulically moved by a difference between a desired pressure and an actual pressure acting directly on the valves, the actual pressure at the actuator must first fall below the desired pressure by a significant amount and remain below the desired pressure for a period of time before any movement of the pump's displacement control valve is initiated. Further, movement of the valve, because it is initiated primarily by the pressure differential across the valve itself, may not provide consistent operation under varying conditions (e.g., under varying temperatures and fluid viscosities). Further, pilot-type valves may exhibit instabilities in some situations because of their slow response time, the instabilities reducing the accuracy of the pump's displacement control.

An attempt to improve pump displacement control is described in U.S. Pat. No. 6,374,722 (the '722 patent) issued to Du et al. on Apr. 23, 2002. Specifically, the '722 patent describes an apparatus for controlling a variable displacement hydraulic pump. The apparatus includes a control servo operable to control an angle of the pump's swashplate, an electro-hydraulic servo valve connected to the control servo, and means for controlling the servo valve as a function of the pump's discharge pressure, as monitored by a discharge pressure sensor. Working on the principle of a negative feedback loop, the control servo is capable of sensing its actual position and comparing the actual position with an intended position that is associated with a desired discharge pressure. If the control servo detects a difference between the intended position and the actual position, the servo valve is energized to adjust the position of the control servo until the intended position is reached. In this way, the built in negative feedback loop of the control servo allows for very precise manipulation of the swashplate angle.

Although the apparatus of the '722 patent may help increase precision regulation of pump displacement, certain disadvantages may still persist. For example, the apparatus may not account for flow forces acting on the valve during operation of the pump. As such, displacement accuracy and response time of the apparatus may still be less than desired.

The disclosed hydraulic control system is directed to overcoming one or more of the disadvantages set forth above and/or other problems of the prior art.

SUMMARY

In one aspect, the present disclosure is directed toward a hydraulic control system. The hydraulic control system may include a pump configured to pressurize fluid, a displacement control valve configured to affect displacement of the pump, and a tool control valve configured to receive pressurized fluid from the pump and to selectively direct to the pressurized fluid to a hydraulic actuator. The hydraulic control system may also include a controller in communication with the displacement control valve. The controller may be configured to determine a pressure gradient across the tool control valve substantially different than a desired pressure gradient, to determine a desired condition of the displacement control valve based the pressure gradient, and to determine a flow force applied to the displacement control valve based on the desired condition. The controller may be further configured to generate a load sense response signal directed to the displacement control valve based on the desired condition and the flow force.

In another aspect, the present disclosure is directed toward a method for controlling fluid flow from a pump. The method may include sensing an undesired pressure gradient resulting from hydraulic tool actuation, determining a desired rate of change in displacement of the pump based on the undesired pressure gradient, and determining a flow force affecting implementation of the desired rate of change in displacement of the pump. The method may further include generating a load sense response signal to implement the desired rate of change in displacement of the pump that accommodates the flow force.

DETAILED DESCRIPTION

Figure 1:
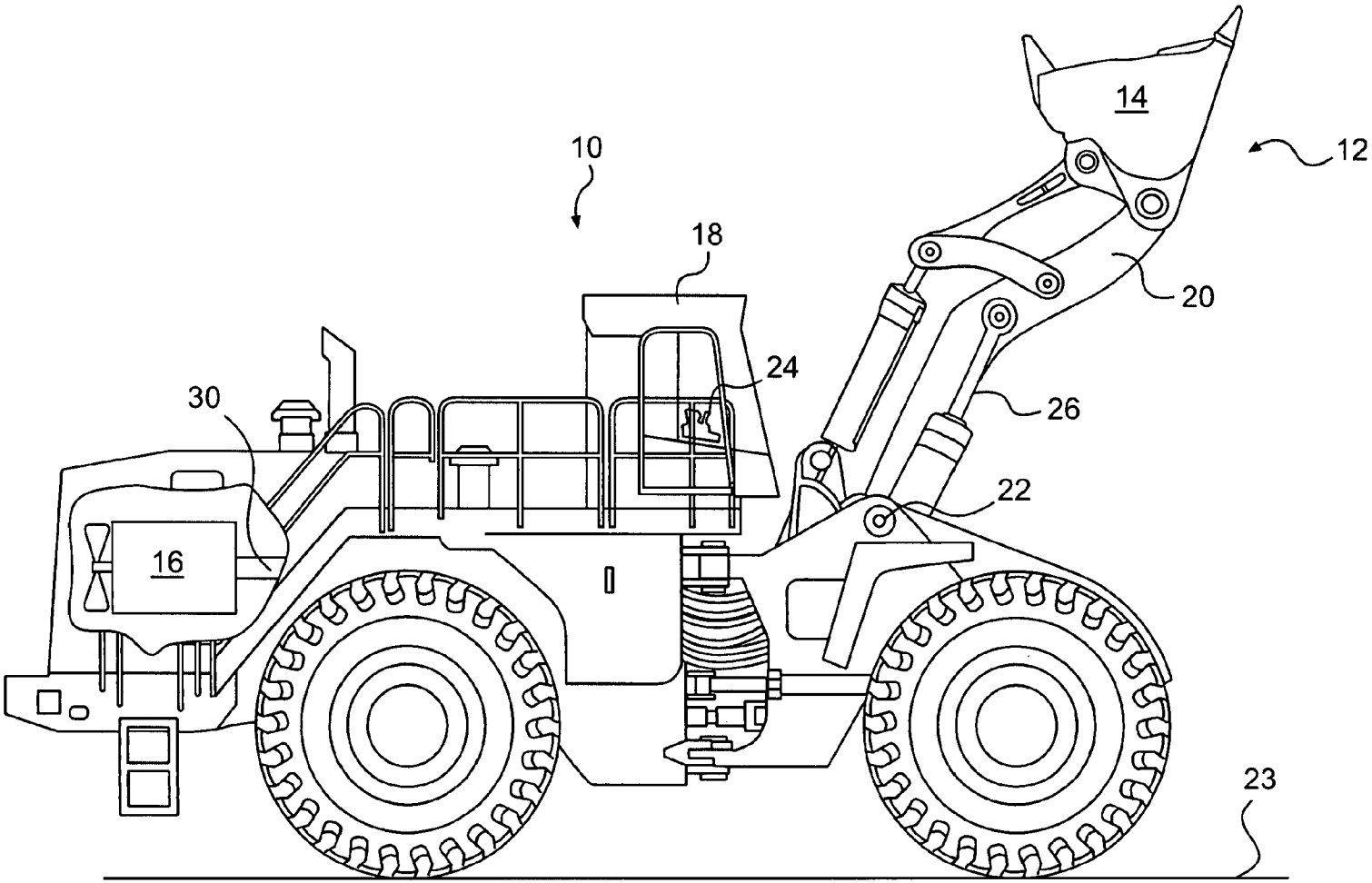
FIG. 1 is a pictorial illustration of an exemplary disclosed machine.

An exemplary embodiment of a machine 10 is illustrated in FIG. 1. Machine 10 may be a mobile or stationary machine capable of performing an operation associated with a particular industry. For example, machine 10 is shown in FIG. 1 configured as a front loader used in the construction industry. It is contemplated, however, that machine 10 may be adapted to many different applications in various other industries such as transportation, mining, farming, or any other industry known to one skilled in the art. Machine 10 may include an implement system 12 configured to move a work tool 14, a power source 16 that provides power to implement system 12, and an operator station 18 for manual and/or automatic control of implement system 12.

Implement system 12 may include a linkage structure acted on by one or more fluid actuators to move work tool 14. In the disclosed example, implement system 12 includes a boom member 20 vertically pivotal about a horizontal axis 22 relative to a work surface 23 by one or more hydraulic actuators 26 (only one shown in FIG. 1), for example one or more cylinders and/or motors. Boom member 20 may be connected to work tool 14 such that activation (e.g., extension and/or retraction) of hydraulic actuators 26 functions to move work tool 14 in a desired manner. It is contemplated that implement system 12 may include different and/or additional linkage members and/or hydraulic actuators than depicted in FIG. 1, if desired.

Work tool 14 may include a wide variety of different implements such as, for example, a bucket, a fork, a drill, a traction device (e.g., a wheel), or any other implement apparent to one skilled in the art. Movement of work tool 14 may be affected by hydraulic actuators 26, which may be manually and/or automatically controlled from operator station 18.

Operator station 18 may be configured to receive input from a machine operator indicative of a desired work tool movement. Specifically, operator station 18 may include one or more operator interface devices 24 embodied as single or multi-axis joysticks located proximal an operator seat. Operator interface devices 24 may be proportional-type controllers configured to position, orient, and/or activate work tool 14 by producing a work tool position signal that is indicative of a desired work tool velocity and/or force. In some examples, the signals from operator interface devices 24 may be used to regulate a flow rate, a flow direction, and/or a pressure of fluid within hydraulic actuators 26, thereby controlling a speed, a movement direction, and/or a force of work tool 14. It is contemplated that different operator interface devices may alternatively or additionally be included within operator station 18 such as, for example, wheels, knobs, push-pull devices, switches, pedals, and other operator interface devices known in the art.

Figure 2:
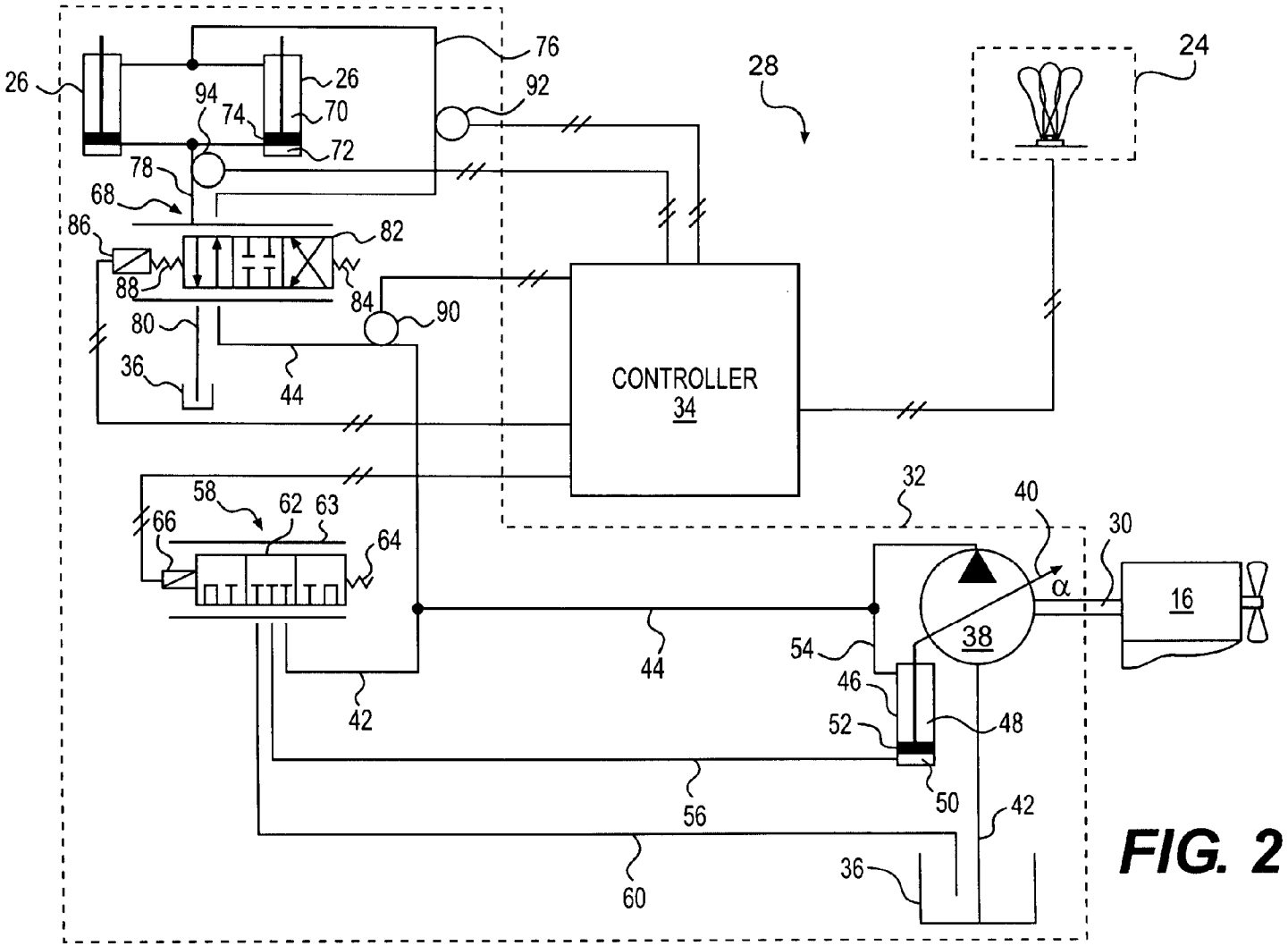
FIG. 2 is a schematic illustration of an exemplary disclosed hydraulic control system that may be used with machine of FIG. 1.

Referring to FIG. 2, power source 16 may be associated with a hydraulic control system 28 that regulates activation of hydraulic actuators 26. Power source 16 may be configured to provide substantially constant power (torque and/or rotational speed) to hydraulic control system 28 by way of a shaft 30. Alternatively, power source 16 may be connected to power hydraulic control system 28 using various other methods such as a gear, a belt, a chain, an electrical circuit, or by any other method known in the art.

Hydraulic control system 28 may include a hydraulic circuit 32, and a controller 34 situated to control fluid flow through hydraulic circuit 32. Hydraulic circuit 32 may itself consist of various fluid components used to direct the flow of pressurized fluid within hydraulic control system 28. For example, hydraulic circuit 32 may include a supply 36 of hydraulic fluid, a pump 38 driven by power source 16 to pressurize the hydraulic fluid, and hydraulic actuators 26 that utilize the pressurized fluid to move work tool 14 (referring to FIG. 1). Controller 34 may communicate with pump 38, hydraulic actuators 26, and/or power source 16 to selectively move work tool 14 according to signals from operator interface device 24.

Pump 38 may generally embody a variable displacement pump having a displacement control device 40. In one example, pump 38 may be an axial piston-type pump equipped with a plurality of pistons (not shown) that may be caused to draw fluid from supply 36 via a passage 42 and to discharge the fluid at elevated pressures to a supply passage 44. In this example, displacement control device 40 may be a swashplate upon which the pistons slide. As the pistons are rotated relative to the swashplate, a tilt angle $\alpha$ of the swashplate may cause the pistons to reciprocate within their bores and generate the pumping action described above. In this manner, the tilt angle $\alpha$ of displacement control device 40 may be directly related to a displacement amount of each piston and, subsequently, to a total displacement of pump 38.

A tilt actuator 46 may be associated with displacement control device 40 to affect tilt angle $\alpha$. In one example, tilt actuator 46 may be a hydraulic cylinder having a first chamber 48 separated from a second chamber 50 by way of a piston assembly 52. First chamber 48 may be in continuous communication with the discharge pressure of supply passage 44 via a first chamber passage 54, while second chamber 50 may be selectively communicated with the discharge pressure and with a lower pressure of supply 36 via a second chamber passage 56.

Piston assembly 52 may be mechanically connected to displacement control device 40 to move displacement control device 40 in response to a force differential across piston assembly 52 caused by fluid pressures within first and second chambers 48, 50. For example, as second chamber 50 is drained of fluid (i.e., fluidly communicated with the lower pressure of supply 36), piston assembly 52 may be caused to retract and thereby increase tilt angle $\alpha$. In contrast, as second chamber 50 is filled with pressurized fluid (i.e., fluidly communicated with the discharge pressure of supply passage 44), piston assembly 52 may be caused to extend and thereby reduce tilt angle $\alpha$. In this configuration, an amount of fluid within second chamber 50 may be related to a position of displacement control device 40, while a rate of fluid flow into and out of second chamber 50 may be related to a velocity of displacement control device 40 and hence a rate of displacement change of pump 38. It is contemplated that the above description of filling and draining of first and second chambers 48, 50 relative to the retraction and extension of piston assembly 52 may be reversed, if desired. It is further contemplated that piston assembly 52 and/or displacement control device 40 may be spring-biased toward a particular displacement position, for example toward a minimum or a maximum displacement position, if desired.

A displacement control valve 58 may be situated in communication with supply passage 44, with second chamber passage 56, and, via a drain passage 60, with supply 36 to control the flow of fluid to and from second chamber 50. Displacement control valve 58 may be one of various types of control valves including, for example, a proportional-type solenoid valve. As shown in both FIGS. 2 and 3, displacement control valve 58 may include a valve element 62 slidably disposed within a body 63 and movable against the bias of a spring 64 to any position between three distinct operating positions by way of a solenoid 66. Solenoid 66 may be selectively energized by controller 34 to move valve element 62 to any desired position.

Figure 3:
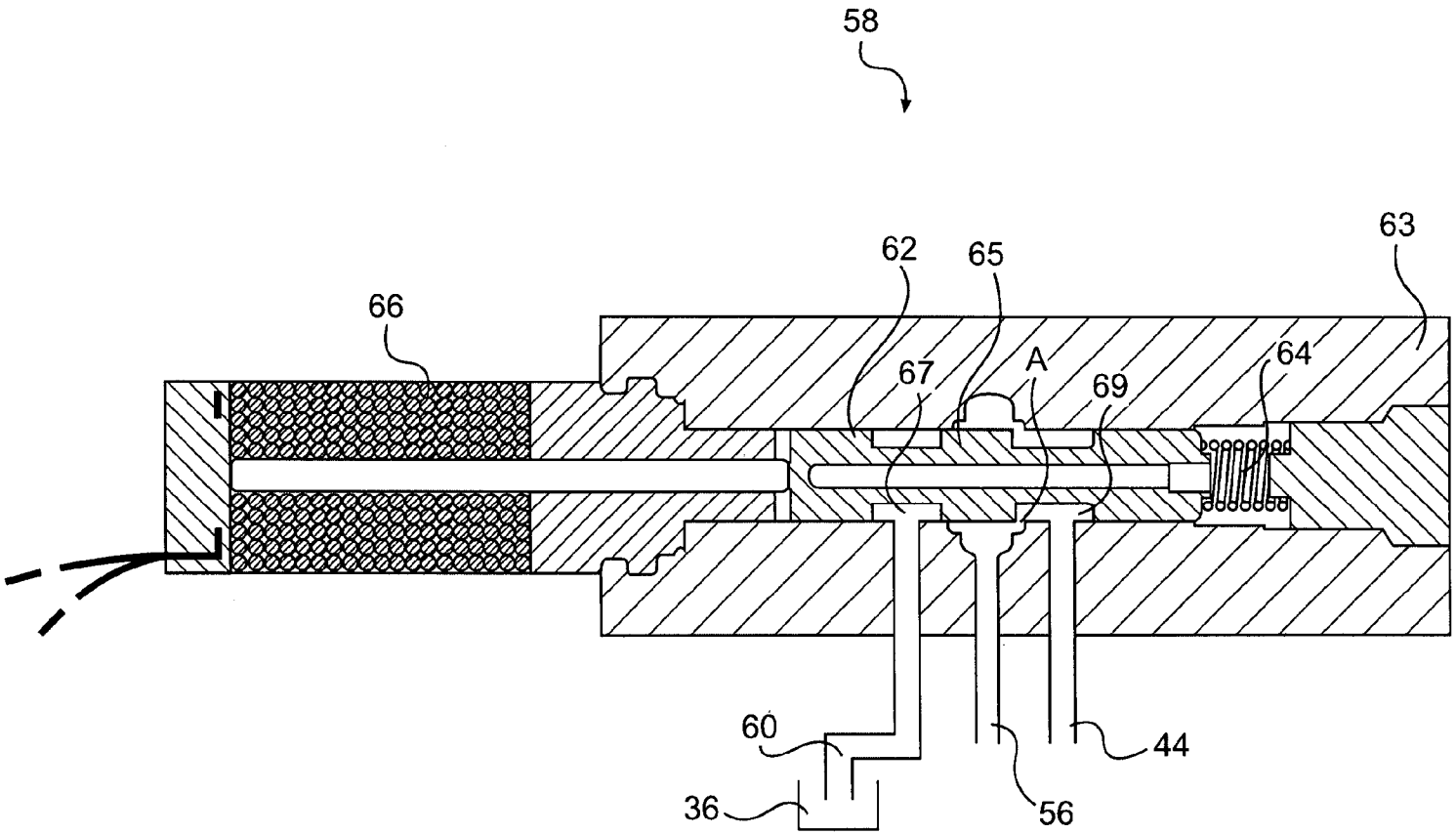
FIG. 3 is a cross sectional illustration of an exemplary disclosed control valve that may be used with the hydraulic control system of FIG. 2.

In one embodiment, shown in FIG. 3, valve element 62 may be a spool having at least one land 65 separating a first annular recess 67 from a second annular recess 69. First annular recess 67 may be in continuous fluid communication with drain passage 60, while second annular recess 69 may be in continuous fluid communication with supply passage 44. In a first position (shown in FIG. 2), land 65 may substantially block fluid flow between supply passage 44 and second chamber passage 56 via second annular recess 69, and between second chamber passage 56 and drain passage 60 via first annular recess 67. In the first position, no adjustment of tilt angle $\alpha$ may occur (i.e., piston assembly 52 may be substantially hydraulically locked from moving displacement control device 40). From the first position shown in FIG. 2, solenoid 66 may be selectively energized to linearly translate valve element 62 to the right to achieve the second position (not shown). In the second position, first annular recess 67 of valve element 62 may connect second chamber passage 56 with drain passage 60, thereby allowing fluid to flow from second chamber 50 to supply 36, effectively depressurizing second chamber 50. In this position, high-pressure fluid in first chamber 48 may cause piston assembly 52 to retract and thereby increase the tilt angle $\alpha$ of displacement control device 40. From the first position shown in FIG. 2, solenoid 66 may be selectively energized to move valve element 62 to the left to achieve the third position (shown in FIG. 3). In the third position, second annular recess 69 may connect second chamber passage 56 with supply passage 44, thereby allowing discharge fluid to flow from pump 38 to second chamber 50, effectively pressurizing second chamber 50. In this position, high-pressure fluid in second chamber 50, combined with a greater effective cylinder area on piston assembly 52, may cause piston assembly 52 to extend and thereby decrease the tilt angle $\alpha$ of displacement control device 40. When valve element 62 is moved to a position between the first and second positions or to a position between the first and third positions, piston assembly 52 may still move to increase or decrease the tilt angle $\alpha$, but may do so at a speed proportional to the position of valve element 62. That is, it is contemplated that fluid flowing through first annular recess 67 and/or through second annular recess 69 may flow at a rate proportional to an effective valve area $A_{valve}$ of the corresponding annular recess 67, 69. As used herein, $A_{valve}$ may refer specifically to the smallest area through which fluid passes within displacement control valve 58.

Referring back to FIG. 2, the pressurized fluid discharge from pump 38 may be selectively directed to move hydraulic actuators 26 by way of a tool control valve 68. In particular, tool control valve 68 may be disposed within passage 44, upstream of hydraulic actuators 26. And, similar to tilt actuator 46, hydraulic actuators 26 may each include first and second chambers 70, 72. In one embodiment, first and second chambers 70, 72 may be separated by a piston assembly 74. In an alternative embodiment, first and second chambers 70, 72 may be separated by an impeller or other known power-translating device. First and second chambers 70, 72 may be selectively supplied with or drained of fluid by tool control valve 68 to affect movement of piston assembly 74 (or of the different power-translating device). For example, when first chamber 70 is filled with pressurized fluid and second chamber 72 is drained of fluid, piston assembly 74 may be retract to lower boom member 20 (referring to FIG. 1). In contrast, when first chamber 70 is drained of pressurized fluid and second chamber 72 is filled with pressurized fluid, piston assembly 74 may extend to raise boom member 20. To fill and drain first and second chambers 70, 72, tool control valve 68 may selectively connect a first chamber passage 76 and a second chamber passage 78 to the discharge of pump 38 via passage 44 and to supply 36 via a drain passage 80.

Tool control valve 68 may be one of various types of control valves including, for example, a proportional-type solenoid valve. That is, tool control valve 68 may include a valve element 82, for example a spool, movable against the bias of a spring 84 to any position between three distinct operating positions by way of a solenoid 86. In one embodiment, solenoid 86 may operatively connected to valve element 82 by way of a spring 88, and selectively energized by controller 34 to move valve element 82 to any desired position.

In a first position (not shown), tool control valve 68 may substantially block all fluid flow into or out of first and second chambers 70, 72. In the first position, no movement of boom member 20 may occur (i.e., piston assembly 74 may be hydraulically locked from moving boom member 20). From the first position, solenoid 86 may be selectively energized to move valve element 82 to the right to achieve the second position (shown in FIG. 2). In the second position, tool control valve 68 may connect first chamber 70 with supply passage 44 by way of first chamber passage 76, and second chamber 72 with supply 36 by way of second chamber passage 78 and drain passage 80. In the second position, first chamber 70 may be filled with pressurized fluid discharged from pump 38, while fluid is drained from second chamber 72 to supply 36. This simultaneous filling of first chamber 70 and draining of second chamber 72 may cause a retraction of piston assembly 74. From the first position, solenoid 86 may be selectively energized to move valve element 82 to the left to achieve the third position (not shown). In the third position, tool control valve 68 may connect first chamber 70 with drain passage 80, and second chamber 72 with supply passage 44. In the third position, second chamber 72 may be filled with pressurized fluid from pump 38, while fluid is drained from first chamber 70. This simultaneous draining of first chamber 70 and filling of second chamber 72 may cause an extension of piston assembly 74. When valve element 82 is moved to a position between the first and second positions or to a position between the first and third positions, piston assembly 74 may still move to lift or lower boom member 20, but may do so at a speed proportional to the position of valve element 82. As valve element 82 is moved between the first, second, and third positions (and as hydraulic actuators 26 consume fluid at varying rates and pressures), a pressure gradient $\Delta P_{68}$ across tool control valve 68 may vary.

One or more sensors may be associated with controller 34 to facilitate precise control over movement of hydraulic actuators 26 and tilt actuator 46. In particular, a first sensor 90 may be located to monitor a discharge pressure of pump 38, for example a pressure of fluid within supply passage 44 upstream of tool control valve 68. A second sensor 92 may be located to monitor a pressure of fluid within first chamber 70, for example a pressure of fluid within first chamber passage 76. A third sensor 94 may be similarly located to monitor a pressure of fluid within second chamber 72, for example a pressure of fluid within second chamber passage 78. Sensors 90-94 may be configured to generate signals indicative of the monitored pressures, and send these signals to controller 34.

As will be described in greater detail below, in response to input from sensors 90-94 and/or from operator interface device 24, controller 34 may adjust operation of control valves 58 and/or 68 to affect movement of tilt actuator 46 and/or hydraulic actuators 26. Controller 34 may embody a single microprocessor, or multiple microprocessors that include a means for controlling and operating components of hydraulic control system 28. Numerous commercially available microprocessors may be configured to perform the functions of controller 34. It should be appreciated that controller 34 could readily embody a general microprocessor capable of controlling numerous machine functions. Controller 34 may include a memory, a secondary storage device, a processor, and any other components for running an application. Various other circuits may be associated with controller 34 such as a power supply circuit, a signal conditioning circuit, a solenoid driver circuit, and other types of circuits.

One or more maps relating various system parameters may be stored in the memory of controller 34. Each of these maps may include a collection of data in the form of tables, graphs, equations and/or another suitable form. The maps may be automatically or manually selected and/or modified by controller 34 or an operator to affect operation of hydraulic control system 28.

Based on signals received from sensors 90-94, controller 34 may regulate operation of displacement control valve 58 to maintain a substantially constant $\Delta P_{68}$. In particular, controller 34 may receive and compare the signals from pressure sensors 90-94 to determine $\Delta P_{68}$ (i.e., to determine a pressure differential between pump discharge pressure within supply passage 44 and the higher of the pressures within first and second chamber passages 76, 78). And, if controller 34 determines that $\Delta P_{68}$ is not about equal to a predetermined value (i.e., within an amount of a desired pressure gradient), controller 34 may generate a load sense response signal directed to displacement control valve 58 that functions to correct $\Delta P_{68}$.

The load sense response signal from controller 34 may result in solenoid 66 being selectively energized to move valve element 62 to a desired position that results in tilt actuator 46 adjusting the tilt angle $\alpha$ of displacement control device 40. For example, if $\Delta P_{68}$ is lower than expected, controller 34 may issue a load sense response signal (i.e., issue a command or send a current) to solenoid 66 that causes solenoid 66 to move valve element 62 toward the second position, thereby causing piston assembly 52 of tilt actuator 46 to retract and increase tilt angle $\alpha$ and, thus, increase the displacement of pump 38. In contrast, if $\Delta P_{68}$ is higher than expected, controller 34 may issue a load sense response signal to solenoid 66 that causes solenoid 66 to move valve element 62 toward the third position, thereby causing piston assembly 52 of tilt actuator 46 to extend and decrease tilt angle $\alpha$ and, thus, decrease the displacement of pump 38. In this manner, a substantially constant $\Delta P_{68}$ may be maintained, which may result in stable and responsive operation of hydraulic actuators 26.

The load sense response signal may be calculated/determined/estimated by controller 34 with reference to the maps stored in memory and based on input from sensors 90-94. In particular, controller 34 may be configured to first determine a desired rate of change in the flow from (i.e., the displacement of) pump 38 based on $\Delta P_{68}$ and the desired constant pressure gradient. In one example, the desired rate of change in the displacement of pump 38 may be determined by direct reference of $\Delta P_{68}$ or by reference of a difference between $\Delta P_{68}$ and the desired constant pressure gradient to the maps stored in the memory of controller 34. In another example, particular operating conditions of hydraulic control system 28, for example a rotational speed of pump 38, may be used in conjunction with $\Delta P_{68}$ to determine the desired rate of change in the displacement of pump 38.

Because of known mechanical connections and/or relationships between movement of displacement control device 40 and the displacement change of individual pistons within pump 38, and because of known mechanical connections and/or relationships between movement of tilt actuator 46 and the resulting tilt angle $\alpha$ of displacement control device 40, the desired rate of change in the displacement of pump 38 can be directly related to a desired velocity V of tilt actuator 46. And, as is commonly known in the art, the velocity (i.e., extension or refraction velocity) of a cylinder (e.g., of tilt actuator 46) may be about equal to a flow rate of fluid Q into that cylinder divided by an effective area $A_{cyl}$ upon which the fluid acts. Further, because the desired velocity can be determined with reference to the maps stored within the memory of controller 34, as described above, and the effective area of piston assembly 52 may be known, the flow rate of fluid required to move tilt actuator 46 at the desired velocity (i.e., required to produce the desired rate of change in the displacement of pump 38) may be calculated according to the following Eq. 1:

$$Q=V\cdot A_{cyl} \qquad \text{Eq. 1}$$

wherein:

Q is the required flow rate of fluid into tilt actuator 46;

V is the desired velocity of piston assembly 52 determined from the maps of controller 34; and $A_{cyl}$ is the known effective area of piston assembly 52.

It is contemplated that fluid flowing through first and/or second annular recesses 67, 69 of displacement control valve 58 may flow at a rate proportional to an effective valve area $A_{valve}$ of the corresponding annular recess. Thus, having determined the flow rate of fluid that must enter tilt actuator 46 to cause pump 38 to respond appropriately to $\Delta P_{68}$ via Eq. 1 above, controller 34 may be configured to determine how displacement control valve 58 must be operated to provide that flow rate. Specifically, controller 34 may be configured to determine the effective area $A_{valve}$ required of displacement control valve 58 based on a commonly-known orifice equation, Eq. 2, below:

$$A_{valve} = \frac{Q}{C_d\sqrt{\frac{2}{\rho}\sqrt{\Delta P_{58}}}} \qquad \text{Eq. 2}$$

wherein:

$A_{valve}$ is the effective area of displacement control valve 58;

Q is the required flow rate of fluid into tilt actuator 46 and through displacement control valve 58 determined from Eq. 1 above;

$C_d$ is a discharge coefficient;

$\rho$ is a density of the fluid passing through displacement control valve 58; and $\Delta P_{58}$ is a pressure gradient across displacement control valve 58.

The discharge coefficient $C_d$ may be used to approximate viscosity and turbulence effects of fluid flow and may be within the range of about 0.5-0.9 and, in one embodiment more specifically about 0.62. Since the discharge coefficient $C_d$, the pressure gradient $\Delta P_{58}$ across displacement control valve 58, and the fluid density $\rho$ may all be substantially constant, $A_{valve}$ may be easily calculated. It should be noted, however, that although $\Delta P_{58}$ and $\rho$ may be assumed to be substantially constant in this example, it is contemplated that measured and/or variable values may be utilized to enhance valve control accuracy, if desired.

Once $A_{valve}$ has been calculated, controller 34 may determine a force $f_k$ required of solenoid 66 to move valve element 62 a distance x against the bias of spring 64 in order to create $A_{valve}$. Specifically, controller 34 may have stored in memory a map (e.g., a displacement vs. area curve) the relates known values of $A_{valve}$ to x. And, according to a well-known spring force equation, Eq. 3 below, controller 34 may be configured to calculate $f_k$:

$$f_k=x\cdot k \qquad \text{Eq. 3}$$

wherein:

$f_k$ is the force required of solenoid 66 to move valve element 62 the distance x against the bias of spring 64;

x is the distance required to produce $A_{valve}$; and k is the spring constant of spring 64.

As fluid moves through displacement control valve 58, inertia, turbulence, and/or viscosity of the fluid itself may exert forces on valve element 62 that should be accounted for to improve accuracy in control over $A_{valve}$. The flow forces acting on valve element 62 may be estimated using Eq. 4 provided below:

$$f_f = 2 \cdot C_d \cdot A_{valve} \cdot \Delta P_{58} \cdot \cos(\phi) \quad \text{Eq. 4}$$

wherein:

$f_f$ are the flow forces;

$C_d$ is the discharge coefficient;

$A_{valve}$ is the effective area of displacement control valve 58;

$\Delta P_{58}$ is the pressure gradient across displacement control valve 58; and $\phi$ is an angle of fluid exodus from $A_{valve}$.

Although the exit angle $\phi$ may vary, in one example, $\phi$ may be assumed to be constant based on laboratory testing, and used to approximate the trajectory of flow forces exiting $A_{valve}$. Since $\Delta P_{58}$, $A_{valve}$, $\phi$, and $C_d$ may be known values, $f_f$ may be calculated and then compensated for during movement of displacement control valve 58. In particular, all of the forces acting on valve element 62 for which solenoid 66 must provide may be determined by summation according to Eq. 5 below:

$$F_s = f_k + f_f \quad \text{Eq. 5}$$

wherein:

$F_s$ is a total force required of solenoid 66;

$f_k$ is the force required of solenoid 66 to move valve element 62 the distance x against the bias of spring 64; and $f_f$ are the flow forces.

Thus, the load sense response signal directed from controller 34 to solenoid 66 in response to $\Delta P_{68}$ having an undesired value may contain a command component associated with $F_s$. In one embodiment, controller 34 may determine, based on reference to a map stored in memory (e.g., a force vs. current curve for solenoid 66), a current required to energize solenoid 66 sufficiently to produce $F_s$. And, controller 34 may be configured to direct this current to solenoid 66 in response to $\Delta P_{68}$.

INDUSTRIAL APPLICABILITY

The disclosed hydraulic control system finds potential application in any machine where cost and precise regulation of pump output are considerations. The disclosed solution finds particular applicability in hydraulic tool systems, especially hydraulic tool systems for use onboard mobile machines. One skilled in the art will recognize, however, that the disclosed hydraulic control system could be utilized in relation to other machines that may or may not be associated with hydraulically operated tools.

During the operation of hydraulic control system 28, a machine operator may manipulate operator interface device 24 (referring to FIG. 1) to command movement of work tool 14. When the machine operator manipulates operator interface device 24, a signal may be generated that is proportional to a displacement position of operator interface device 24. This signal may be received by controller 34 and may be translated into one or more response commands directed to tool control valve 68 that cause valve element 82 to move between its three positions.

As pressurized fluid flows through tool control valve 68 and into one of first and second chambers 70, 72, the pressure of the corresponding first and second chamber passages 76, 78 may change. Controller 34 may determine the pressure gradient across tool control valve 68 ($\Delta P_{68}$) by utilizing signals received from pressure sensors 90-94. Controller 34 may compare $\Delta P_{68}$ to a predetermined value (i.e., to a desired pressure gradient) and generate a corresponding load sense response signal.

The load sense response signal may result in a required adjustment to the displacement of pump 38 to vary output. For example, if the pressure gradient $\Delta P_{68}$ is too low, the load sense response signal may cause the displacement of pump 38 increase. Conversely, if the pressure gradient $\Delta P_{68}$ is determined to be too high, the load sense response signal may cause the displacement of pump 38 decrease.

As described above, controller 34 may calculate/estimate/determine/generate the load sense response signal based on Eq. 1-5. In particular, controller 34 may first relate $\Delta P_{68}$ to a desired rate of change in the flow from (i.e., the displacement of) pump 38. This desired rate of change of pump displacement may then be related to a desired velocity (V) of tilt actuator 46, from which the desired flow rate (Q) of fluid through displacement control valve 58 may be calculated according to Eq. 1. Based on Q and an assumed constant pressure gradient across displacement control valve 58 ($\Delta P_{58}$), the corresponding effective area of displacement control valve 58 ($A_{valve}$) may be calculated according to Eq. 2. After relating $A_{valve}$ to a linear translation of valve element 62 (x), the force required of solenoid 66 to overcome the bias of spring 64 caused by x ($f_k$) may be calculated according to Eq. 3. In addition, the force required of solenoid 66 to overcome forces associated with the flow of fluid through displacement control valve 58 ($f_f$) may be calculated based on $A_{valve}$, $\Delta P_{58}$, and the assumed constant exit angle of the fluid at $A_{valve}$ ($\phi$) according to Eq. 4. The total force required of solenoid 66 ($F_s$) may then be calculated according to Eq. 5, and a corresponding command component of the load sense response signal may be sent to energize solenoid 66.

As will be apparent, the described method and apparatus may provide accuracy in the control of pump displacement by compensating for flow forces caused by a moving fluid. Flow force compensation may help enable responsive and predictable work tool actuation in constant pressure hydraulic systems. Additionally, flow force compensation may help eliminate the need for position-correcting servomechanisms used in other systems. By reducing the need for servomechanisms, the described system may reduce errors associated with position correction, improve pump response, and reduce instabilities and cost.

It will be apparent to those skilled in the art that various modification and variations can be made to the disclosed hydraulic control system, without departing from the scope of the disclosure. Other embodiments of the disclosed hydraulic control system will be apparent to those skilled in the art from consideration of the specification and practice disclosed herein. It is intended that the specification and examples be considered as exemplary only, with the true scope being indicated by the following claims and their equivalents.

What is claimed is:

1. A hydraulic control system, comprising:

a pump configured to pressurize fluid;

a displacement control valve configured to affect displacement of the pump, the displacement control valve further configured to receive pressurized fluid from the pump;

a tool control valve configured to receive pressurized fluid from the pump and to selectively direct the pressurized fluid to a hydraulic actuator; and a controller in communication with the displacement control valve and being configured to:

determine a pressure gradient across the tool control valve substantially different than a desired pressure gradient;

determine a desired condition of the displacement control valve based on the pressure gradient;

determine a flow force applied to the displacement control valve based on the desired condition; and generate a load sense response signal directed to the displacement control valve based on the desired condition and the flow force.

2. The hydraulic control system of claim 1, wherein the desired condition is associated with a desired flow of fluid through the displacement control valve.

3. The hydraulic control system of claim 2, wherein the desired condition is an effective area that provides the desired flow of fluid.

4. The hydraulic control system of claim 3, wherein the flow force is a result of the desired flow of fluid through the effective area.

5. The hydraulic control system of claim 4, wherein the flow force is determined based further on an angle of fluid exodus from the effective area.

6. The hydraulic control system of claim 5, wherein the angle of fluid exodus is assumed to be constant.

7. The hydraulic control system of claim 3, wherein:

the displacement control valve includes a valve element, and a spring configured to bias the valve element; and the controller is further configured to determine a linear translation of the valve element that provides the effective area, and to determine a force applied by the spring to the valve element as a result of the linear translation.

8. The hydraulic control system of claim 7, wherein:

the displacement control valve further includes a solenoid configured to move the valve element; and the load sense response signal is indicative of an amount of force required of the solenoid to overcome the force applied by the spring and the flow force.

9. The hydraulic control system of claim 3, wherein the effective area is calculated based on a pressure gradient across the displacement control valve.

10. The hydraulic control system of claim 9, wherein the pressure gradient across the displacement control valve is assumed to be constant.

11. The hydraulic control system of claim 9, further including at least one pressure sensor associated with the tool control valve to measure the pressure gradient across the tool control valve.

12. The hydraulic control system of claim 1, further including:

a displacement control device movable to vary the displacement of the pump; and a tilt actuator configured to move the displacement control device, wherein the displacement control valve is fluidly connected to activate the tilt actuator.

13. The hydraulic control system of claim 12, wherein the desired condition is associated with a desired flow of fluid through the displacement control valve that results in a desired velocity of the tilt actuator.

14. A method of controlling fluid flow from a pump, comprising:

sensing an undesired pressure gradient resulting from hydraulic tool actuation;

determining a desired rate of change in displacement of the pump based on the undesired pressure gradient;

determining a flow force affecting implementation of the desired rate of change in displacement of the pump; and generating a load sense response signal to implement the desired rate of change in displacement of the pump that accommodates the flow force, the load sense response signal controlling a flow of pressurized fluid from the pump, the pressurized fluid from the pump being used to implement the desired rate of change in displacement of the pump.

15. The method of claim 14, wherein:

the desired rate of change in displacement of the pump is associated with an effective valve area that provides a desired flow of fluid to adjust displacement of the pump; and the flow force is a result of the desired flow of fluid through the effective valve area.

16. The method of claim 15, wherein determining the flow force includes determining the flow force based on the effective valve area and on an angle of fluid exodus from the effective valve area.

17. The method of claim 16, further including determining a valve element translation required to provide the effective valve area and a spring bias associated with the valve element translation, wherein the load sense response signal also accommodates the spring bias.

18. The method of claim 15, wherein the effective valve area is calculated based on a pressure gradient resulting from a displacement change of the pump.

19. The method of claim 18, further including:

sensing the pressure gradient resulting from hydraulic tool actuation; and assuming the pressure gradient resulting from the displacement change of the pump to be constant.

20. A machine, comprising:

a power source;

a pump driven by the power source to pressurize fluid;

a tool;

a hydraulic actuator configured to move the tool;

a tool control valve configured to receive pressurized fluid from the pump and to selectively direct the pressurized fluid to the hydraulic actuator;

a displacement control valve configured to affect displacement of the pump, the displacement control valve further configured to receive pressurized fluid from the pump; and a controller in communication with the displacement control valve and being configured to:

determine a pressure gradient across the tool control valve substantially different than a desired pressure gradient;

determine a desired condition of the displacement control valve based the pressure gradient;

determine a linear translation of the displacement control valve required to produce the desired condition;

determine a spring force resulting from the linear translation;

determine a flow force applied to the displacement control valve based on the desired condition; and generate a load sense response signal directed to the displacement control valve based on the desired condition, the spring force, and the flow force.

* * * * *